US006561358B2

(12) United States Patent
Kolton et al.

(10) Patent No.: US 6,561,358 B2
(45) Date of Patent: May 13, 2003

(54) HANGER FOR ARTICLE DISPLAY CONTAINER AND CONTAINER LID

(75) Inventors: Chester Kolton, Westfield, NJ (US); Michael Norman, East Brunswick, NJ (US); Robert Whittemore, Middletown, NY (US)

(73) Assignee: B&G Plastics, Inc., Newark, NJ (US)

( * ) Notice: Subject to any disclaimer, the term of this patent is extended or adjusted under 35 U.S.C. 154(b) by 0 days.

(21) Appl. No.: 09/953,792

(22) Filed: Sep. 17, 2001

(65) Prior Publication Data

US 2003/0052243 A1 Mar. 20, 2003

(51) Int. Cl.[7] ..... B65D 75/00
(52) U.S. Cl. ..... 206/806; 223/85
(58) Field of Search ..... 206/736, 806, 206/583, 427; 223/85; 248/309.1, 311.2, 311.3, 316.7

(56) References Cited

U.S. PATENT DOCUMENTS 3,645,485 A * 2/1972 Gold ..... 206/459.5
4,696,402 A * 9/1987 Harmon et al. ..... 206/703
4,905,949 A * 3/1990 Cosgrove ..... 211/74
4,948,036 A * 8/1990 Loughman ..... 206/427
6,036,063 A * 3/2000 Rhyne ..... 223/85

* cited by examiner

*Primary Examiner*—Shian Luong
(74) *Attorney, Agent, or Firm*—Robin, Blecker & Daley

(57) ABSTRACT

A hanger provides for the display of an article container having wall structure extending from a floor of the container to an open end permitting viewing of the article and a lid for the container, the hanger including a hanger portion and a support portion depending from the hanger portion and having a first course extending transversely forwardly of the hanger portion, a second course defining a bend continuous with an end of the first course, a third course extending transversely from the second course toward the hanger portion and continuous with the second course, a fourth course extending transversely rearwardly of the hanger portion and a fifth course extending downwardly from an end of the fourth course, the first and third courses defining a slot therebetween having one slot end closed by the second course and a second open slot end. One using the hanger places container wall structure in the slot by inserting the third hanger course into the open end of the container. The container lid is in pressure relationship with fifth hanger course.

3 Claims, 2 Drawing Sheets

HANGER FOR ARTICLE DISPLAY CONTAINER AND CONTAINER LID

FIELD OF THE INVENTION

This invention relates generally to container hangers and pertains more particularly to hangers for use in instances where a retailer wishes to display an article in its container and provides a lid for closing the container.

BACKGROUND OF THE INVENTION

FIG. 1 depicts a display arrangement common in retail establishments, where display shelf 10 supports container 12 having open end 14 permitting viewing of an article 16 within the container. Container closure lid 18 circumscribes the closed bottom of container 12.

Two drawbacks attend such display arrangement. Firstly, closure lid 18 frequently becomes separated from container 12, and need be found or replaced by checkout counter personnel. Secondly, given that closure lid 18 is disposed about the closed bottom of container 12, a tilting of the container and displayed article is at hand, giving rise to less than desired display aesthetics.

SUMMARY OF THE INVENTION

The present invention has as its primary object to overcome the foregoing drawbacks in the display of an article in its container with the container lid disposed about the closed bottom of the container.

In attaining this and other objects, the invention provides a hanger for the display of an article container having wall structure extending from a floor of the container to an open end permitting viewing of the article and a lid for the container; the hanger comprising: a hanger portion; and a support portion depending from the hanger portion and having a first course extending transversely forwardly of the hanger portion, a second course defining a bend continuous with an end of the first course, a third course extending transversely from the second course toward the hanger portion and continuous with the second course, a fourth course extending transversely rearwardly of the hanger portion and a fifth course extending downwardly from an end of the fourth course, the first and third courses defining a slot therebetween having one slot end closed by the second course and a second open slot end.

The following combination is thus afforded by the invention, i.e., an article container having wall structure extending from a floor of the container to an open end permitting viewing of an article disposed in an interior of the container and lid for the container, the lid being disposed in circumscribing relation to the container at an end thereof opposite the container open end and defining sidewall structure extending from container closure structure and a hanger for the article container, the hanger comprising a hanger portion, and a support portion depending from the hanger portion and having a first course extending transversely forwardly of the hanger portion, a second course defining a bend continuous with an end of the first course, a third course extending transversely from the second course toward the hanger portion and continuous with the second course, a fourth course extending transversely rearwardly of the hanger portion and a fifth course extending downwardly from an end of the fourth course, the first and third courses defining a slot therebetween having one slot end closed by the second course and a second open slot end.

The wall structure of the container is disposed in the support portion slot. The support portion fourth course overlies the lid sidewall structure. The support portion fifth course is in abutting relation to the container closure structure of the lid.

The invention will be further understood from consideration of the following description of preferred embodiments thereof and from the drawings where like reference numerals identify like parts throughout.

DETAILED DESCRIPTION OF PREFERRED EMBODIMENTS AND PRACTICES

Figure 1:
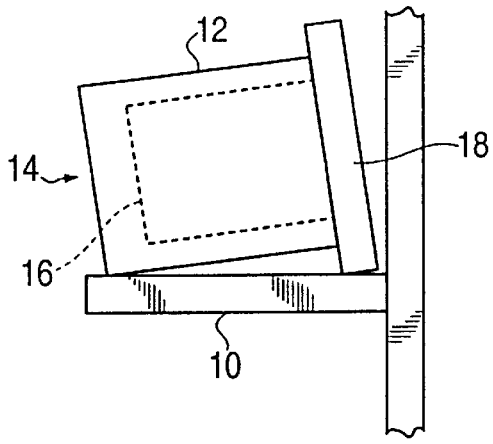
FIG. 1 (PRIOR ART)
FIG. 1 depicts a display arrangement common in retail establishments.
Figure 2:
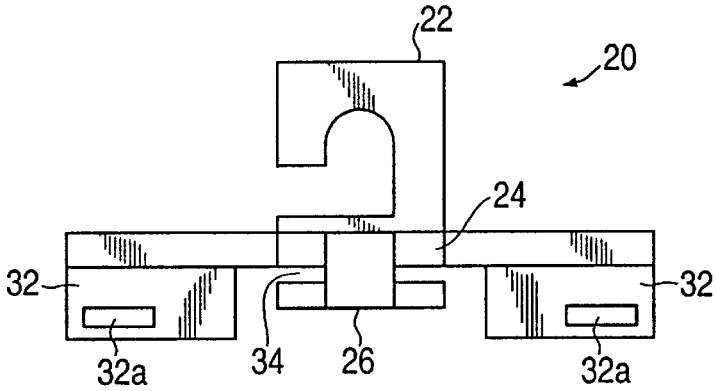
FIG. 2 is a front elevation of a hanger in accordance with the subject invention.
Figure 3:
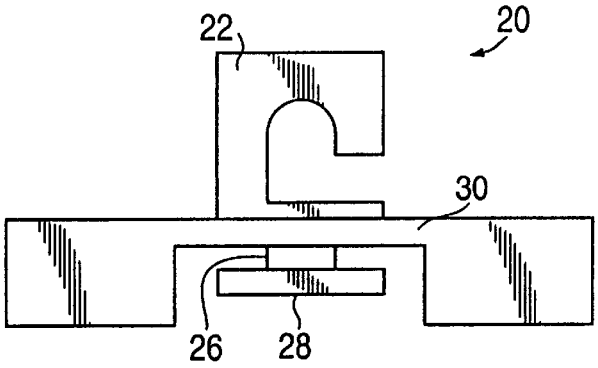
FIG. 3 is a rear elevation of FIG. 2.
Figure 4:
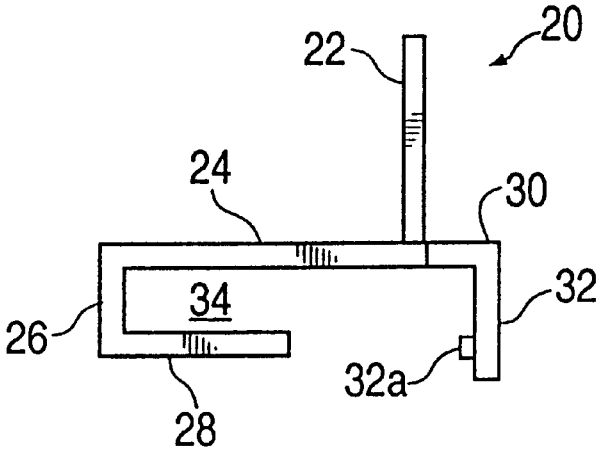
FIG. 4 is a right side elevation of FIG. 2.

Referring to FIGS. 2–4, hanger 20 of the invention is an integral body, suitably comprised of molded plastic and includes hanger portion 22 and a support portion depending from the hanger portion and having first course 24 extending transversely forwardly (horizontally leftwardly in FIG. 4) of hanger portion 22. Second course 26 defines a bend or U-turn continuous with an end of first course 24. Third course 28 extends transversely from second course 26 toward hanger portion 22 and is continuous with second course 26. Fourth course 30 extends transversely rearwardly (horizontally rightwardly in FIG. 4) of hanger portion 22. Fifth courses 32 extend downwardly from ends of fourth course 30 and may have engagement ribs 32*a* projecting therefrom toward hanger portion 22.

First course 24 and third course 28 define slot 34 therebetween, the slot having one slot end dosed by second course 26 and a second open slot end.

Figure 5:
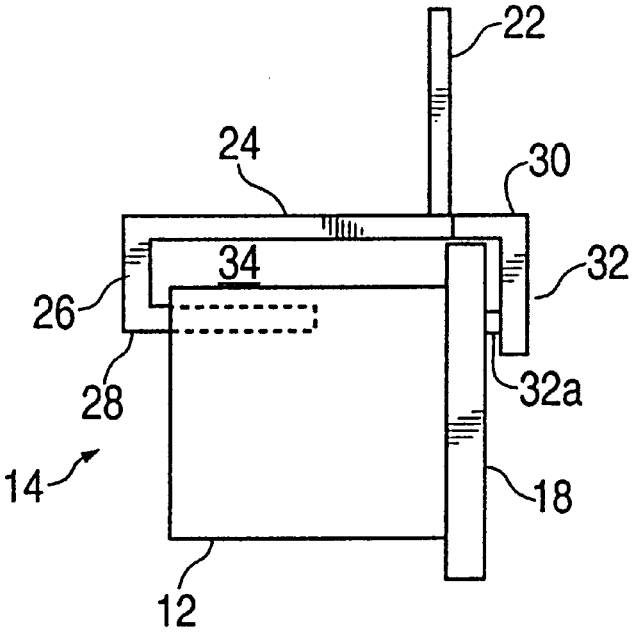
FIG. 5 shows the hanger of the invention in assembly with an article display container and its closure lid.

As is seen from the assembly view of FIG. 5, one using hanger 20 of FIGS. 2–4 places container wall structure in slot 34 by inserting third course 28 into open end 14 of container 12. Hanger 20 is dimensioned accordingly with diverse containers and lids, such that in final assembly of hanger 20 with a container and its lid, lid 18 is in pressure relationship with fifth course 32, or with its engagement ribs 32*a* when they are used.

Various changes to the particularly depicted embodiments of the invention may be introduced without departing from the scope of the invention. Containers hung by the hanger of the invention may of course have any cross-section, e.g., circular, rectangular, etc. Accordingly, it is to be appreciated that the particularly disclosed embodiments are intended in an illustrative, and not in a limiting, sense. The true spirit and scope of the invention is set forth in the ensuing claims.

What is claimed is:

1. In combination:

(a) an article container having wall structure extending from a floor of the container to an open end permitting viewing of an article disposed in an interior of the container and a lid for the container, said lid being disposed in circumscribing relation to said container at an end thereof opposite said container open end and defining sidewall structure; and (b) a hanger for said article container, said hanger comprising (1) a hanger portion, and (2) a support portion depending from said hanger portion and having a first course extending transversely forwardly of said hanger portion, a second course defining a bend continuous with an end of said first course, a third course extending transversely from said second course toward said hanger portion and continuous with said second course, a fourth course extending transversely rearwardly of said hanger portion and a fifth course extending downwardly from an end of said fourth course, said first and third courses defining a slot therebetween having one slot end closed by said second course and a second open slot end, said wall structure of said container being disposed in said support portion slot, said support portion fourth course overlying said lid sidewall structure, said support portion fifth course being in abutting relation to said lid.

2. The invention claimed in claim 1, wherein said support portion is integral with said hanger portion.

3. The invention claimed in claim 2, wherein said support portion and said hanger portion are constituted by a molded plastic.

* * * * *